United States Patent [19]

Finkenbeiner

[11] Patent Number: 4,589,322

[45] Date of Patent: May 20, 1986

[54] GLASS HARMONICA

[76] Inventor: Gerhard Finkenbeiner, 33 Rumford Ave., Waltham, Mass. 02154

[21] Appl. No.: 522,485

[22] Filed: Aug. 12, 1983

[51] Int. Cl.[4] ..... G10D 13/08

[52] U.S. Cl. ..... 84/402; 84/410

[58] Field of Search ..... 84/402–410, 84/103

[56] References Cited

U.S. PATENT DOCUMENTS 4,217,807 8/1980 Nutting et al. ..... 84/402

FOREIGN PATENT DOCUMENTS 258723 4/1912 Fed. Rep. of Germany ..... 84/103

664764 9/1929 France ..... 84/103

*Primary Examiner*—Benjamin R. Fuller

*Attorney, Agent, or Firm*—Herbert L. Bello

[57] ABSTRACT

A glass harmonica with a plurality of quartz cups of different sizes coaxially arranged on a spindle which is rotated by a variable speed motor. The cups are held on the spindle by intermediate mounting members which are slidable along the axis of the spindle. End mounting members, which are mounted on the spindle, clamp the cups so that they rotate with the spindle. A range of musical tones are produced when the rims of the rotating cups are touched by a player's fingertips, either the fingertips are moistened or the edges of the cups are moistened by a moisturizer.

14 Claims, 3 Drawing Figures

GLASS HARMONICA

BACKGROUND OF THE INVENTION

1. Field of the Invention

The present invention relates to musical instruments and, more particularly, is directed towards glass harmonicas.

2. Description of the Prior Art

Musical instruments comprised of quartz and glass elements have been used for many years. Applicant's copending application Ser. No. 388,550 describes a tone generator having a quartz rod and clapper for producing bell tones. The glass harmonica, which was introduced in the latter part of the eighteenth century, has a plurality of revolving glass bowls of various sizes which, when touched by moistened fingertips produce a wide range of notes. The quality of the sound produced by the glass harmonica is related to the speed at which the bowls revolve, the wetness of the fingertips and the amount of pressure applied against the rims of the bowls. Due to difficulties in the manufacture and quality of the sound produced by bowls, the glass harmonica has had very limited success.

SUMMARY OF THE INVENTION

An object of the present invention is to provide an improved glass harmonica.

Another object of the invention is to provide a glass harmonica for producing a wide range of musical sounds of high tonal quality. The glass harmonica has a plurality of quartz cups of various sizes which are coaxially arranged on a rotatable spindle. The cups are mounted on intermediate mounting members which are slidably received on the spindle. End mounting members which are mounted on the spindle clamp the cups so that they rotate with the spindle. The spindle is rotated by a variable speed motor, the speed of which is governed by a controller. Musical sounds are produced by a player touching the rims of the revolving cups with his fingertips. Either the player's fingertips are moistened or the rims of the quartz cups are moistened. The frequency of the sound produced by the glass harmonica is determined by the composition and size of the cups, the rate at which the cups are rotated, the amount of moisture between the fingertips and the cups and the pressure applied against the rim of the cups.

A further object of the invention is to provide a method for making fused quartz musical cups which are characterized by a high resistance to breakage.

Other objects of the present invention will in part be obvious and will in part appear hereinafter.

The invention accordingly comprises the apparatusses, processes and products, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
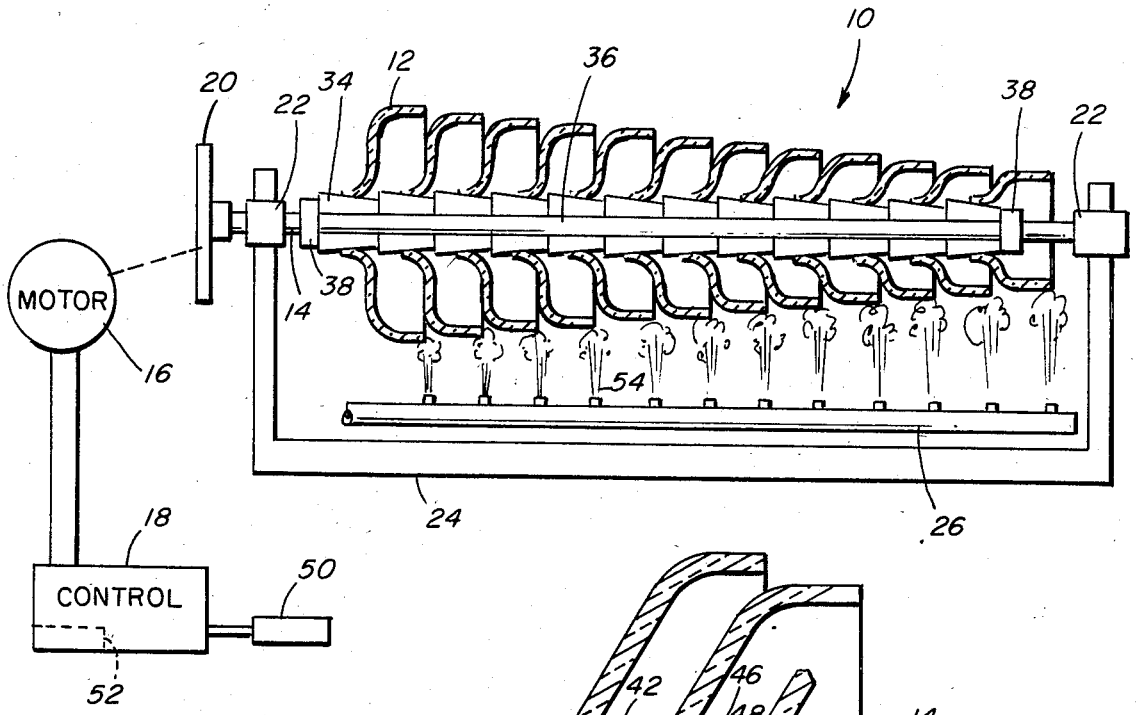
FIG. 1 is a block and schematic diagram of a musical instrument embodying the present invention.
Figure 3:
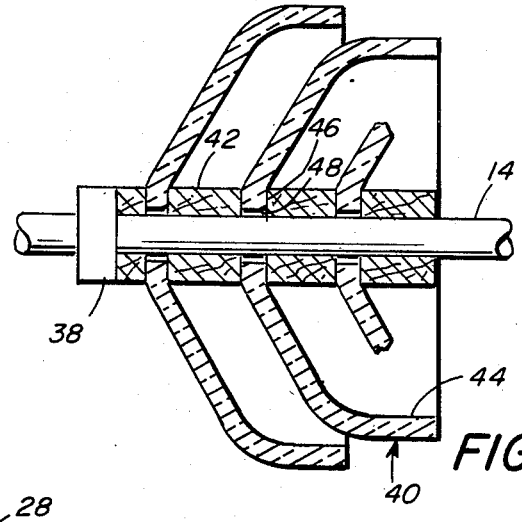
FIG. 3 is a side elevation, in cross section, of an alternate embodiment of the invention.

Referring now to the drawings, particularly FIG. 1, there is shown a musical instrument 10 in the form of a glass harmonica having a plurality of musical cups 12 which are coaxially mounted on a spindle 14. A drive motor 16, the speed of which is controlled by a controller 18, is drivingly connected to spindle 14 via a pulley 20, for example. Spindle 14 is supported in a pair of bearings 22 which are carried on a frame 24. As hereinafter described, a moisturizer 26 is provided for moisturizing the rims of cups 12.

Figure 2:
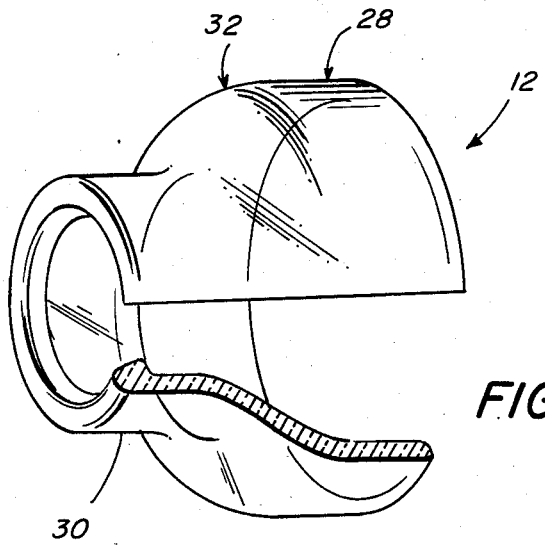
FIG. 2 is a perspective view, partly brokenaway, of quartz cup made according to the present invention.

As shown in FIG. 2, each cup 12 includes a substantially cylindrical body 28 which tapers inwardly to form a narrow neck 30. The radius of curvature at the point denoted by reference character 32, the point at which body 28 begins to taper inwardly, has a radius of curvature which is no greater than $\frac{1}{8}''$. This small radius of curvature will result in the standing sound waves of the cups 12 being contained in the area of the cup between the edge of body 28 and the beginning of the tapered portion at reference character 32. Typically, glass harmonica 10 has three octaves, the lowest note being produced as a "C" (130 Hz). The cups 12 are arranged in descending order according to their size, the largest cup at one end of the spindle 14 and the smallest cup at the other end of the spindle. In this embodiment, the largest cup 12 identified as 12L and located at one end of spindle 14, produces a note "C" and has a diameter of approximately 8" and a wall thickness of 1/16". The smallest cup 12, identified as 12S and located at the other end of spindle 14, has a diameter of $1\frac{1}{2}''$ and a wall thickness of 1/16".

In the embodiment shown in FIG. 1, each cup 12 is secured to spindle 14 by a cork 34 which is slidably received on the spindle. Each cork 34 has a tapered body onto which the cup 12 is tightly fitted, the large end of cork 34 having a diameter of approximately $1\frac{1}{2}''$. Each cork 34 is provided with a central through hole 36 which provides a tight fit with spindle 14. That is, through hole 36 is sufficiently large to permit cork 34 to slide along the axis of spindle 14 and is sufficiently small to provide a tight fit with the spindle. In the illustrated embodiment, by way of example, spindle 14 is a metal rod having a diameter of $\frac{3}{4}''$, the ends of the spindle being threaded. End members 38 are internally threaded members, for example nuts, which are turned onto the threaded end of spindle 14. End members 38 prevent movement of corks 34 along the axis of spindle 14 and clamp the quartz cups 12 against relative rotational movement with respect to the spindle. That is, end mounts 38 and corks 34 define a mounting fixture by which cups 12 are mounted to spindle 14 in such a way that the cups are constrained against movement along the axis of the spindle and are clamped to rotate when the spindle is rotated by motor 16. When end mounts 38 are removed, cups 12 can be moved along the axis of the spindle 14.

In an alternate embodiment of musical instrument 10, cups 12 are replaced with conical-shaped cups 40 which are coaxially disposed on spindle 14, the cups being separated by spacers 42 which slidably fit on the spindle. Each cup 40 has a conical-shaped profile defined by a substantially cylindrical body 44 which tapers inwardly to a flat section 46. A through hole 48 is formed in each flat portion 46, the diameter of the through hole being larger than the diameter of the spindle 14. The surface area of each spacer 42 which abuts the flat portion 46 of the cups 40 is sufficiently large so that the cups are firmly clamped between adjacent ones of the spacers. As in the case of FIG. 1, end mounts 38 are provided for clamping the spacers 42 to spindle 14, the end mounts preventing relative axial and rotational movement of the cups 40 and the spindle 14.

In the illustrated embodiment, by way of example, motor 16 is a variable speed electric motor and controller 18 regulates the speed of the motor from 0–120 rpm. Preferably, controller 18 is provided with a foot pedal 50 and a feed-back circuit 52 for rapidly and instantaneously changing the speed of motor 16. It is to be noted that the smaller cups 12 require a faster speed for satisfactory sound than the larger cups.

According to the present invention, cups 12 and 40 are comprised of a heat treated, fused quartz glass. In the process of making the quartz cups highly resistant to breakage, the entire outer surface of the cup is rapidly and momentarily heated to a temperature of 1190° C., a few degrees above its melting temperature, by a superhot hydrogen/oxygen fire while keeping the inner core of the cups below the melting temperature of fused quartz. Then, the cups are allowed to cool to room temperature. In this way, no detectable physical deformation of the cups occurs and the tuning of the cup remains unaffected by this heat treatment. The cups have a perfectly smooth surface which increases their resistance to breakage by a factor in the order of 10.

In an alternative process of the invention for forming quartz cups which are highly resistant to breakage, each cup is heated to a temperature of 1190° C., which is above the melting point by a few degrees (50°) into the liquid phase of quartz. The cup is maintained at this temperature for a sufficiently long period of time to permit equalization of the temperature throughout the cup. It has been found that the quartz cup will not lose its previous tuning when exposed to a temperature which is a few degrees into the liquid phase of the quartz. During this forming process, the quartz cup is rotated along its longitudinal axis at a speed that exactly compensates for the shrink tendency of the cup caused by surface tension of the material. Then, water is sprayed on the outer surface of the cup to rapidly drop the temperature of the outer surface. This process brings the outer surface back to the solid phase while the core of the cup remains in the liquid phase. With further cooling of the cup, the inner core will shrink for a while until it reaches the solid phase. The surfaces which cannot shrink any longer because they have reached their solid phases earlier will be exposed to compression due to the fact that the core has been shrinking to a smaller demension. It is to be noted that quartz does not fail under compression. When a cup is dropped on the floor, the compression that occurs on contact will cause a tension on the outside surface of the cup. The method described artificially enlarges the outer surface so that it finds itself always under compression due to a reduced inner core. In this situation, even if the cup is dropped, the surface will not make a transition from compression to tension and therefore the cup will not break. The previously described heat treatments have no negative effect on the musical qualities of the quartz cups.

In operation of glass harmonica 10, power is applied to controller 18 and moisturizer 26, for example a steam generator. The steam emitted from steam generator 26 passes through a plurality of ports 54 and is directed toward cups 12. Foot pedal 50 is depressed, motor 15 is energized and spindle 14 together with cups 12 rotates at a speed specified by the setting of the foot pedal. A player touches the rims of revolving moistened cups 12 with his fingertips to generate tones. By selectively controlling rotational speed of the cups 12 and touching the appropriately sized cup, a player can produce a variety of high quality tones. In an alternate embodiment, instead of having moisturizer 26, the player moistens his fingertips with water or alcohol.

Since certain changes may be made in the foregoing description without departing from the scope of the invention herein involved, it is intended that all matter contained in the above description and depicted in the accompanying drawings be construed in an illustrative and not in a limiting sense.

What is claimed is:

1. A musical instrument comprising:

(a) a frame:

(b) a rotatable spindle mounted to said frame;

(c) a plurality of quartz cups of different sizes coaxially mounted to said spindle, said quartz cups slidable along the axis of said spindle, said quartz cups configured to produce musical tones;

(d) mounting means for mounting said quartz cups on said spindle, said quartz cups being fixed against slidable movement along the axis of said spindle and fixed against rotation movement relative to said spindle by said mounting means; and (e) drive means operatively connected to said spindle, said quartz cups constrained to rotate with said spindle, said musical tones being produced by rubbing said rotating quartz cup.

2. The musical instrument as claimed in claim 1 wherein each said quartz cup has a cylindrical body and a narrowed neck.

3. The musical instrument as claimed in claim 2 wherein said mounting means includes cup mounting means and end mounting means coaxially and slidably received on said spindle, said cup mounting means slidable along the axis of said spindle, said cups captively held to said cup mounting means, said end mounting means mounted on said spindle, said cup mounting means fixed against movement along the axis of said spindle and fixed against rotatable movement relative to said spindle by said end mounting means.

4. The musical instrument as claimed in claim 1 wherein said drive means includes a variable speed motor and a controller for controlling the speed of said variable speed motor.

5. The musical instrument as claimed in claim 1 including moisture means positioned near said quartz cups for providing moisture thereto.

6. A musical instrument comprising:

(a) a frame;

(b) a rotatable spindle mounted to said frame;

(c) a plurality of quartz cups configured to produce musical tones, said quartz cups coaxially arranged on said spindle, said quartz cups slidable along the axis of said spindle;

(d) mounting means for mounting said quartz cups on said spindle, said quartz cups fixed against movement along the axis of said spindle and fixed against rotational movement relative to said spindle by said mounting means;

(e) drive means operatively connected to said spindle for rotating said spindle, said quartz cups producing said musical tones when rubbed while being rotated with said spindle; and (f) moisturizing means positioned near said quartz cups for providing moisture thereto.

7. The musical instrument as claimed in claim 6 wherein each said quartz cup has a cylindrical body and a narrowed neck.

8. The musical instrument as claimed in claim 7 wherein said mounting means includes cup mounting means and end mounting means, said cup mounting means coaxially and slidably received on said spindle, said cup mounting means slidable along the axis of said spindle, said cups captively held to said cup mounting means, said end mounting means mounted on said spindle, said cup mounting means fixed against movement along the axis of said spindle and fixed against rotatable movement relative to said spindle by said end mounting means.

9. A musical instrument comprising:

(a) a frame;

(b) a rotatable spindle mounted to said frame;

(c) a plurality of quartz cups of different sizes coaxially mounted to said spindle, said cups slidable along the axis of said spindle;

(d) mounting means for mounting said cups on said spindle, said cups being fixed against slidable movement along the axis of said spindle and fixed against rotation movement relative to said spindle by said mounting means;

(e) drive means operatively connected to said spindle for rotating said spindle, said quartz cups constrained to rotate with said spindle; and (f) a steam generator positioned near said quartz cups for providing moisture thereto, said steam generator having ports for directing steam toward said quartz cups.

10. A musical instrument comprising:

(a) a frame;

(b) a rotatable spindle mounted to said frame;

(c) a plurality of musical cups coaxially arranged on said spindle, said cups slidable along the axis of said spindle, said cups comprised of quartz, each said quartz cup having a cylindrical body and a narrowed neck;

(d) mounting means for mounting said cups on said spindle, said cups fixed against movement along the axis of said spindle and fixed against rotational movement relative to said spindle by said mounting means;

(e) drive means operatively for rotating said spindle, said cups constrained to and rotating with said spindle;

(f) moisturizing means positioned near said cups for providing moisture thereto;

(g) said mounting means including cup mounting means and end mounting means, said cup mounting means coaxially and slidably received on said spindle, said cup mounting means slidable along the axis of said spindle, said cups captively held to said cup mounting means, said end mounting means mounted on said spindle, said cup mounting means fixed against movement along the axis of said spindle and fixed against rotatable movement relative to said spindle by said end mounting means; and (h) said cup mounting means including a plurality of corks for mounting said cups to said spindle, said corks slidable along the axis of said spindle, said cups tightly fitted to said corks.

11. The musical instrument as claimed in claim 10 wherein said spindle is a rod having threads at both ends and wherein said end mounting means are internally threaded members which are turned onto said threaded ends.

12. The musical instrument as claimed in claim 10 wherein said cup mounting means includes a plurality of spacer means, said spacer means slidable along the axis of said spindle, at least one of said spacer means positioned between adjacent ones of said cups, said end mounting means mounted to said spindle at opposite ends thereof for holding said cups and spacer means on said spindle, said spacer means fixed against slidable movement along the axis of said spindle and said cups fixed against rotatable movement relative to said spindle by said end mounting means.

13. The musical instrument as claimed in claim 12 wherein said spindle is a rod having threads at both ends and wherein said end mounting means are internally threaded members which are turned into said threaded ends.

14. A musical instrument comprising:

(a) a frame;

(b) a rotatable spindle mounted to said frame;

(c) a plurality of musical cups coaxially arranged on said spindle, said cups slidable along the axis of said spindle;

(d) mounting means for mounting said cups on said spindle, said cups fixed against movement along the axis of said spindle and fixed against rotational movement relative to said spindle by said mounting means;

(e) drive means operatively connected to said spindle for rotating said spindle, said cups constrained to and rotating with said spindle; and (f) a steam generator positioned near said cups for providing moisture thereto, said steam generator having a plurality of ports which are positioned to direct steam emitted from said steam generator toward said cups.

* * * * *